US005667237A

United States Patent [19]

Lauer

[11] Patent Number: 5,667,237

[45] Date of Patent: Sep. 16, 1997

[54] ROTARY LOCKING FEATURE FOR SNOWBOARD BINDING

[76] Inventor: Jonathan L. Lauer, 3 Wildwood Ter., Winchester, Mass. 01890

[21] Appl. No.: 496,963

[22] Filed: Jun. 30, 1995

[51] Int. Cl.[6] ..... A63C 9/081

[52] U.S. Cl. ..... 280/607; 280/618; 280/14.2

[58] Field of Search ..... 280/611, 618, 280/623, 11.36, 14.2, 607, 620

[56] References Cited

U.S. PATENT DOCUMENTS 5,028,068 7/1991 Donovan ..... 280/14.2
5,277,635 1/1994 Gillis ..... 280/14.2

*Primary Examiner*—Richard M. Camby
*Attorney, Agent, or Firm*—Francis E. Marino

[57] ABSTRACT

A system is provided for allowing rotation of a snowboard binding relative to the snowboard without removal of the binding from the foot, by means of a releasable latch, integral with the binding, to disengage a rotational locking mechanism.

16 Claims, 15 Drawing Sheets

ROTARY LOCKING FEATURE FOR SNOWBOARD BINDING

FIELD OF THE INVENTION

This invention generally relates to snowboards and to bindings which engage the user's feet thereto, and more specifically to bindings which may be conveniently rotated with respect to the snowboard.

BACKGROUND OF THE INVENTION

Snowboards have been a popular sporting device for many years. A snowboard is a singular device ridden by a user standing thereon to slide down a snowy slope. The board is a relatively broad, relatively short, and relatively planar device having two bindings on the top thereof into which a user may place his shod feet so that, unlike when using a pair of skis, both of the user's feet of fixedly positioned relative to one another, on the singular board, during use. Due to the shape of the board and the method of riding, the bindings and feet are generally positioned on the board one behind the other, that is to say one foot towards the front of the board and one foot towards the back, and the bindings and feet are directed generally towards the same side of the board, although they are rarely parallel to one another.

Owing to the various physical qualities of various users, and the various positions deemed comfortable by each user, it is well recognized that optimal binding locations on the board will generally vary for each user. Many binding attachment schemes have been practiced to allow modification of the locations of the bindings relative to the board and to one another. These schemes have been the subject of many patents.

Also owing to the comfort variations of various user's and even of each user during various times, as well as owing to riding conditions and/or terrain conditions, optimal binding directions relative to the board and to one another will generally vary.

Various riding techniques and techniques of use dictate different optimal binding positions at different times, even for the same user. For instance, while sliding down a gradual slope, a user may prefer more or less opening to the angle between the front and back foot than when sliding down a steeper slope. Different riding styles or disciplines, for example slalom, half-pipe, giant slalom, etc., require different optimum stance angles. When traversing a flat unsloped area, the user will generally remove the back foot from the back binding and use that back foot to push h'self and the board forward. While doing so, it is generally more effective to direct the front foot and binding at a slight inward angle from forward. When waiting in queue at a chair lift or riding uphill thereon, the back foot is again removed from the back binding and it is generally more comfortable, more convenient and safer to direct the front foot and binding straight forwardly. While so riding the lift uphill with the front foot and binding so directed, the board may thereby be positioned comfortably on the footrest of the typical chair lift. This prevents the need to and inconvenience of completely removing the board.

The stresses on the user's body during snowboarding can be quite extreme. It is quite common to travel at high speed over bumpy downhill terrain during use as intended. It is relatively common to suffer violent falls and collisions during use not as intended. It has been suggested that such intended and unintended stresses are compounded by the awkward and fixed positioning of the feet on the board. It has been suggested that optimal positioning of the feet on the board for a given user during a given type of use will reduce the likelihood of injury during such intended and unintended use.

It can be easily appreciated that the ability of a user to conveniently redirect the feet and bindings is a advantageous over the inability to do so.

It can also be easily appreciated that the ability of a binding to allow movement of the foot during extreme stresses and thereby relieve those stresses otherwise transmitted to the body is safer than the inability to do so.

Several schemes have been devised to allow rotation of the bindings relative to the board and therefore relative to one another. To date, these schemes have been devised to allow the user to modify the rotational direction of the bindings only when the user's feet are not in the bindings, and only with the use of tools to perform the directional modification.

Such a scheme is disclosed by Carpenter et al in U.S. Pat. No. 5,261,689. As so disclosed, Carpenter's binding direction must be adjusted by first removing the user's foot from the binding, then loosening a hold-down plate by unscrewing an array of mounting screws with a screwdriver, then rotating the binding relative to the board about the mounting plate, then retightening the screws with the screwdriver, then replacing the foot into the binding. The required removal of the binding from the foot and required use of a tool are considered by the present inventor to be a drawback to this scheme. Not only is the inconvenience of removing the binding considered disadvantageous, but the tedious unscrewing and rescrewing of six screws to adjust both bindings is considered quite burdensome. The need to safely carry a screwdriver during snowboarding is an even further consideration to the user. Even though such means have been provided to allow rotation of the bindings, the inconvenience of doing so may be such a discouragement from doing so that very little advantage over having no such means is actually provided.

OBJECTS OF THE INVENTION

It is the object of the present invention to provide an improved snowboard binding.

It is a further object to provide such a binding that is conveniently rotatable without the use of tools.

It is a further object to provide such a binding that is conveniently rotatable while the binding is being worn.

It is a further object to provide such a binding that includes clutch means to allow movement of the bindings and feet during falls and collisions without allowing the board to separate from the bindings and feet.

It is a further object to provide such a binding which is lightweight to avoid being burdensome during use, yet strong to withstand normal stresses during use and abnormal stresses during fails and collisions.

It is a further object to provide such a binding that may be easily and economically manufactured with a minimal number of components.

SUMMARY OF THE INVENTION

The present invention comprises a binding system for a snowboard which allows the user to rotate the binding to any of a number of rotational positions while the binding is being worn. To pivotably affix the binding to the snowboard, the binding system comprises an inverted frusto-conical hold-down plate which is disposed through an inverted frusto-conical hole in the binding, and engages the board by screws. The hold-down plate includes a plurality of peripheral voids which define position locators. The binding includes a detent mechanism having a release latch with engagement and release positions, to engage or disengage the hold-down plate respectively. The detent mechanism includes a spring to bias the detent against the position locators when the latch is in the engagement position. In the engagement position, the latch is aligned with and against the binding to reduce its exposure and accidental movement thereof during use. When moved by the user to the release position, the latch pulls the detent away from the hold-down plate, against the bias of the spring. When the detent and a position locator are not properly aligned and the latch is moved back to the engagement position, the spring maintains an engagement force to the detent against the hold-down plate, and the binding can be further rotated for proper alignment, whereby the detent will then engage the aligned position locator. This feature is beneficial as herein embodied, when the binding is actually being worn at the time of adjustment since the hold-down plate is covered by the user's foot and the position locators are not available for visual alignment. The biasing spring further serves as a clutch in cooperation with the detent and position locators to allow emergency rotation of the binding under abnormally high rotational forces even when the latch is the engagement position. This is particularly beneficial during accidents when those abnormal forces might otherwise cause injury if the binding system was unyielding. A spring tension adjustment screw knob may be provided to allow selection of a threshold force at which the emergency release occurs. This screw knob is conveniently disposed on the detent mechanism and is particularly beneficial in circumstances where the snowboard is to be used by more than one individual at different times, and the users are of differing weights and/or having differing abilities, and thereby requiring differing release thresholds.

Although a simple reversal of design could embody the invention with the detent mechanism in the hold-down plate and the position locators in the binding, and such an embodiment is anticipated by the present inventor, the present embodiment is preferred because the detent mechanism is always positioned aside the user's foot, out of the way and convenient for adjustment.

Other objects and advantages of the invention will become apparent through the description of the preferred embodiment provided herewith and the appended drawings, of which the following is a brief description.

DESCRIPTION OF THE PREFERRED EMBODIMENT OF THE INVENTION

Figure 1:
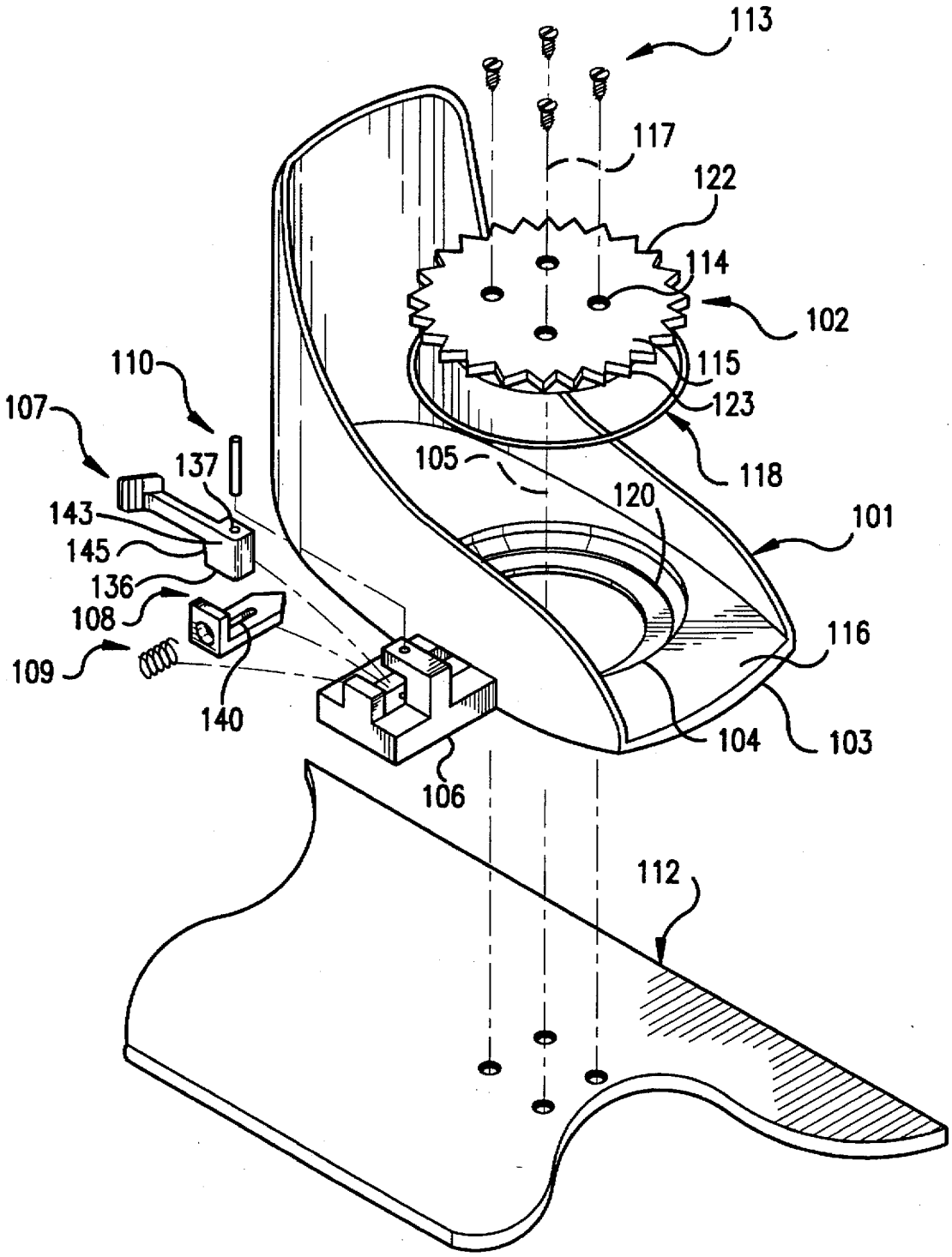
FIG. 1 is an exploded assembly drawing of the preferred embodiment of a binding system in accordance with the invention.
Figure 2:
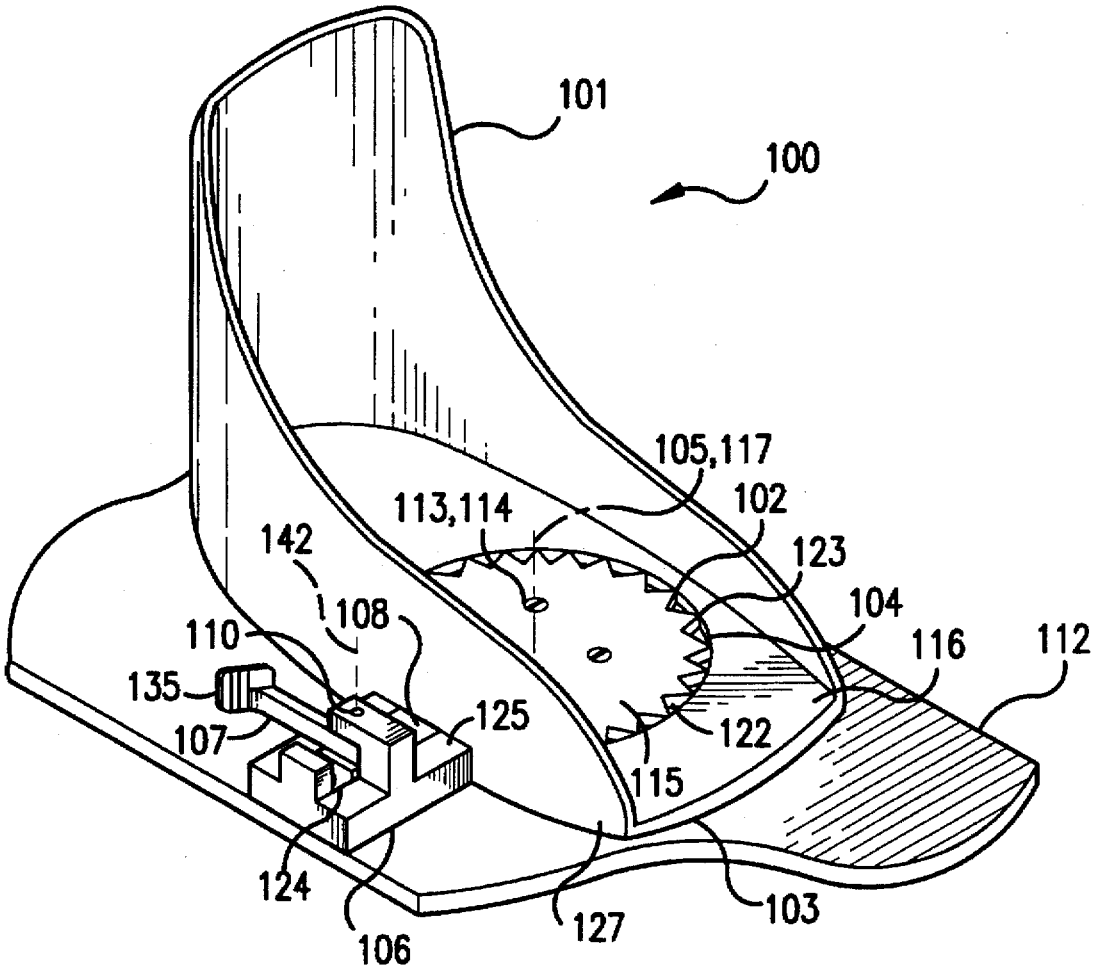
FIG. 2 is a perspective view of the preferred embodiment in the engagement mode.
Figure 3:
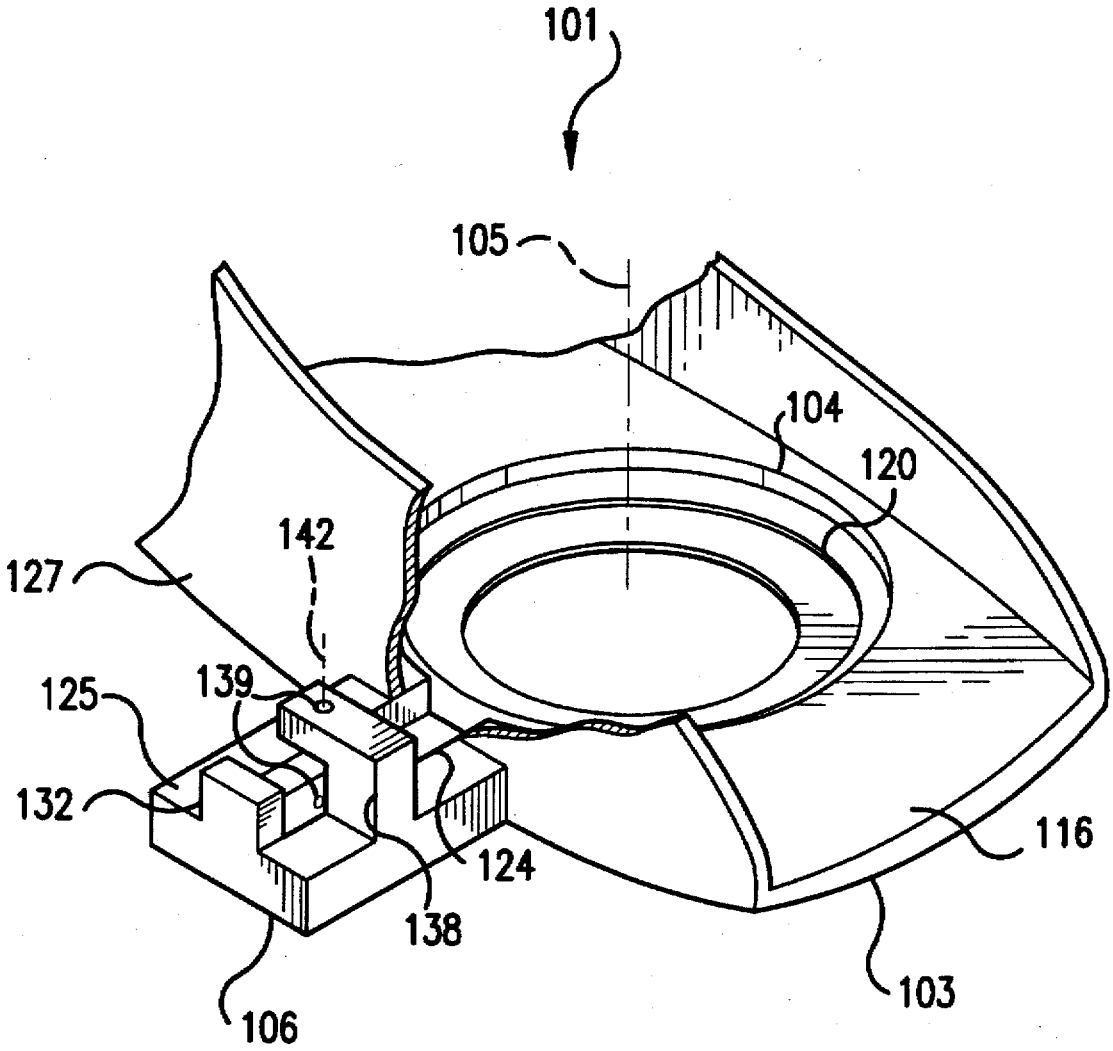
FIG. 3 is a partially cut-away perspective view of the binding portion of the preferred embodiment.
Figure 4:
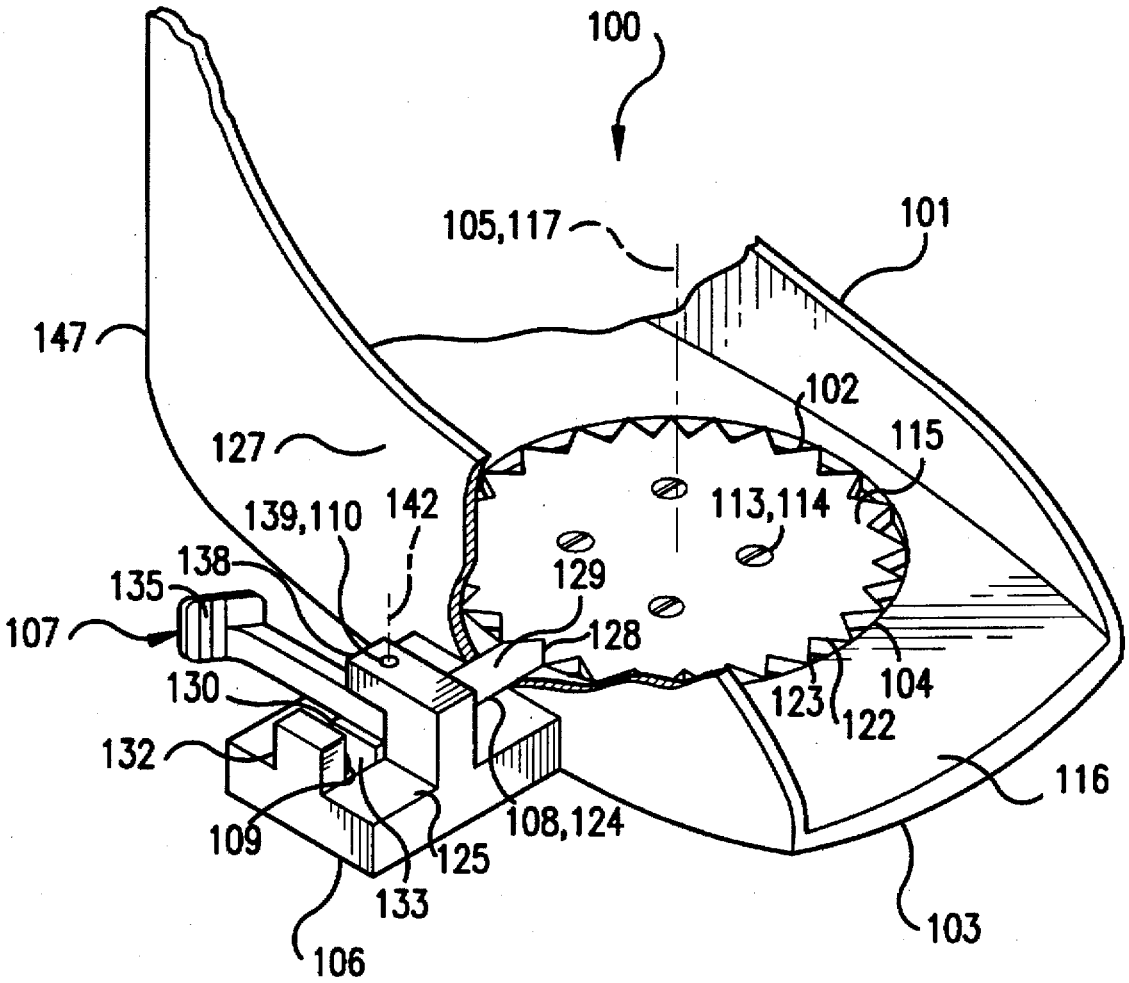
FIG. 4 is a partially cut-away perspective view of the preferred embodiment in the engagement mode.

Referring to FIG. 1, the preferred embodiment comprises binding 101 and holddown plate 102. The binding may be of any of the many known embodiments from the prior art, and is therefor depicted somewhat schematically throughout the drawings. The binding base 103 is substantially flat and is provided with inverted frusto-conical hole 104, which defines binding pivot axis 105. Base 103 further comprises base extension 106 which is adapted to accept latch 107, detent 108, spring 109, and pin 110.

Figure 13:
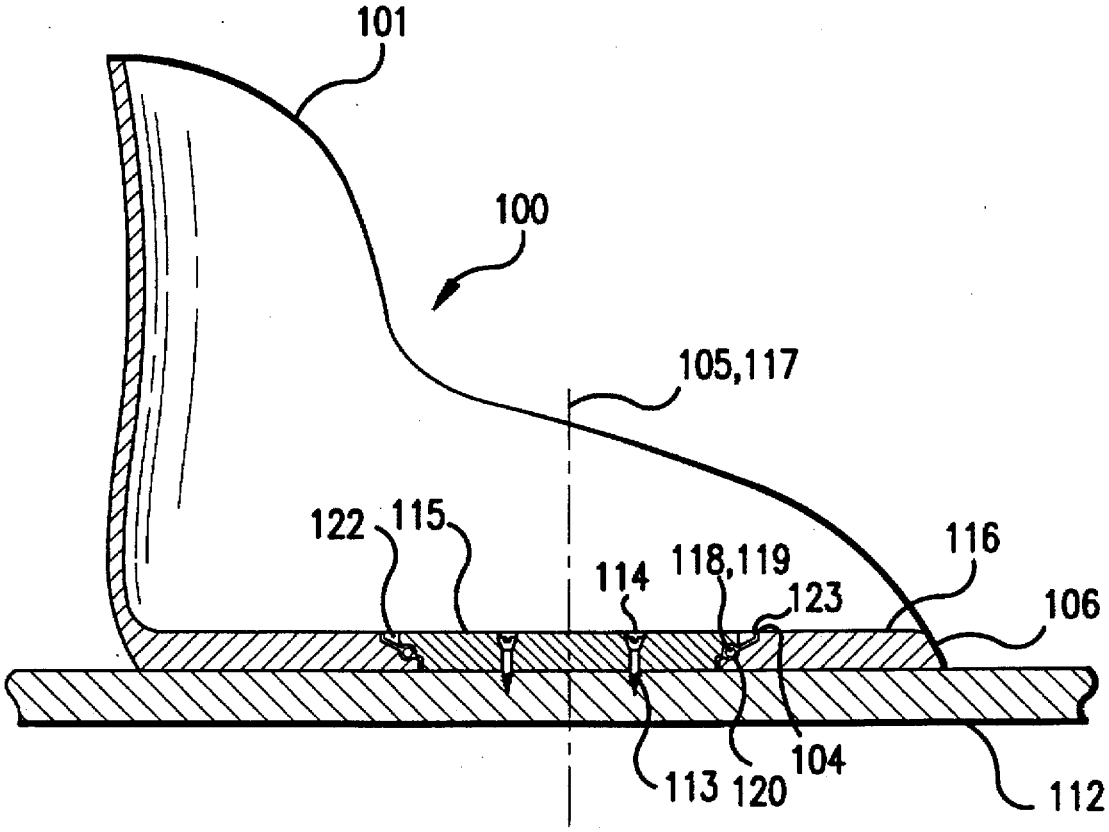
FIG. 13 is a cut-away side-view of the preferred embodiment taken at plane C—C of FIG. 6.
Figure 14:
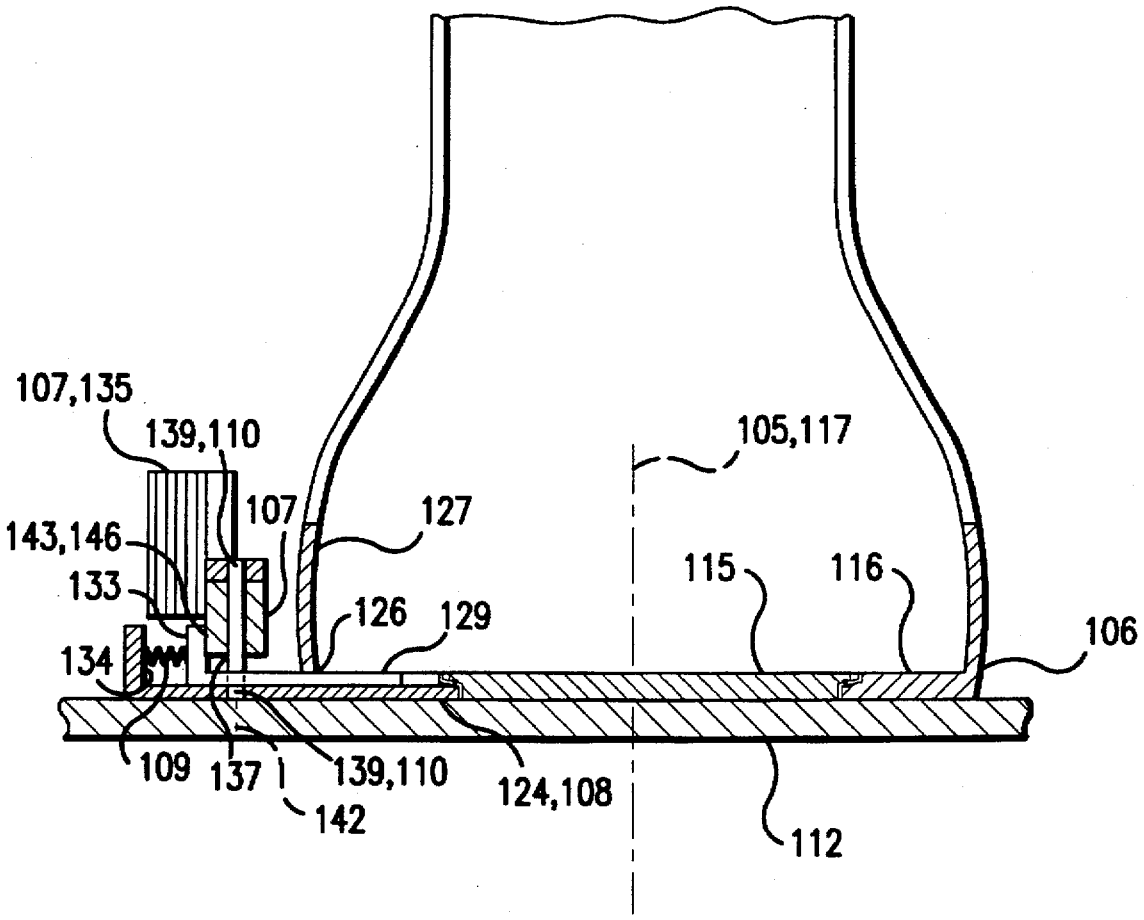
FIG. 14 is a cut-away front view of the preferred embodiment taken at plane D—D of FIG. 6.

Hold-down plate 102 has an inverted frusto-conical shape which is best seen by reference to the cut-away views of FIGS. 13 and 14. The plate is adapted to be mounted to snowboard 112 by screws 113 though screw holes 114. The shape and height of the plate is equivalent to but slightly smaller than the shape of hole 104 and height of base 103, such that when the hold-down plate is fitted within the hole and is attached to the snowboard, the plate's top surface 115 does not protrude above the base's top surface 116. When fully engaged as such, pivot axis 105 and the plate's conical axis 117 are coaxial, and the hold-down plate allows free rotation of the binding about the common axes. Rubber o-ring 118 is disposed within annular groves 119 and 120, of the hold-down plate and binding respectively, to provide both a slight friction during rotation and shock-absorption during use.

The hold-down plate comprises a plurality of equally spaced vee-shaped position locating voids 122 around its perimeter 123 and thereby around the plate's conical axis 117. Slot 124 of the binding extends along the base extension's top surface 125, through rectangular hole 126 of the binding's side wall 127, and along the base's top surface 116 to frusto-conical hole 104. The slot is aligned radially with pivot axis 105 such that it is further aligned with certain of the position locators 122 during certain rotational positions of the binding relative to the base. Detent 108 is disposed within slot 124 and includes pointed tip 128, which is adapted to fit individually within each of the position locating voids. The detent moves longitudinally within the slot, which is to say radially relative to pivot axis 105. The height of the detent within the depth of the slot provides that the detent's top surface 129 does not protrude above the base's top surface 116. The detent further includes vertical tab 130, disposed externally from the binding side wall 127 and projecting upwardly above the slot 124.

At the end of slot 124 distant from pivot axis 105 is disposed vertical wall 132 of the base extension 106. Spring 109 is disposed between the vertical tab's outer side 133 and the vertical wall's inner side 134 and adapted to exert a separating force therebetween, which forces the detent's pointed tip 128 against the hold-down plate's perimeter 123, and into a position locating void 122 if so aligned therewith.

Latch 107 comprises handle 135, cam 136, and through hole 137. Base extension 106 further comprises yoke 138 and vertical pin hole 139 through the yoke and the base. The latch is positioned within the base extension such that the cam is disposed under the yoke and between the detent's vertical tab 130 and the binding side wall 127, and such that the latch's through hole 137 is aligned with the base's vertical pin hole 139 and with pin slot 140 which is disposed through detent 108, theretogether defining pin axis 142. Pin 110 is disposed though the vertical pin hole 139, the latch's through hole 137, and the detent's pin slot 140, and the latch is free to pivot about pin axis 142, while the detent slot 140 allows the detent 108 to slide within the slot 124, regardless of the pin.

Figure 5:
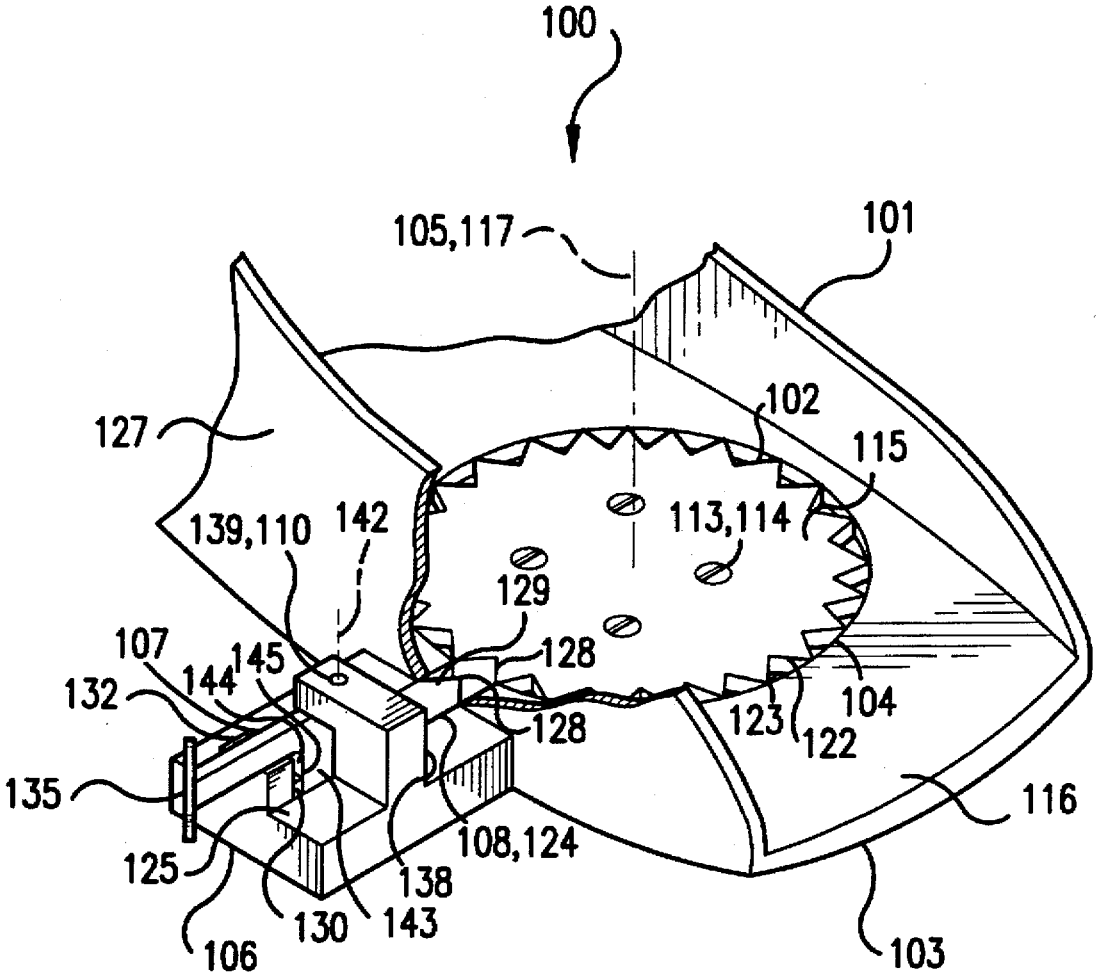
FIG. 5 is a partially cut-away perspective view of the preferred embodiment in the release mode.

Cam 136 is adapted with engagement surface 143, release surface 144, and transition zone 145 therebetween. These surfaces individually engage the vertical tab's inner wall 146 to limit the detent's position against the force of biasing spring 109. The latch has two operational positions, the engagement position, depicted in FIGS. 2, 4, 6, 9, 10, 11, 12, and 14, and the release position, depicted in FIGS. 5, 7, and 8. During the latch's release position, release surface 144 engages the vertical tab's inner wall. During the latch's engagement position, and provided that the detent's pointed tip 128 is aligned with and engaged with a position locating void 122, engagement surface 143 engages the vertical tab's inner wall. During the latch's travel between the engagement and release positions, transitional zone 145 engages the vertical tab's inner wall. The engagement surface is less distant from pin axis 142 than is the release surface. In the transitional zone, the cam's surface is more distant from the pin axis than is the engagement or release surface. The latch's engagement and release positions are thereby it's only stable positions during its rotation about the pin axis. In the engagement position spring 109 is at its maximum allowable extension and the detent 108 is allowed to engage the hold-down plate 102 and deny the binding rotation about the pivot axis and relative to the snowboard. In the release position the spring is in a more compressed state and the detent is held by the cam's release surface from engagement with the hold-down plate, allowing the binding to rotate. The transitional position is not a stable position for the latch, as the spring is at it's maximum compression and works to drive the latch into either of the engagement or release positions. This provides an over-center effect which allows the user to flick the handle positively from one position to the other, and avoids the likelihood that the latch would be dangerously left in a half-way position.

During the latch's engagement position, the handle 135 is generally aligned and against the binding side wall 127, angled outwardly only enough to facilitate grasping thereof, and directed back towards the binding's heal end 147. During the release position, the handle portion extends outwardly from the binding. This arrangement allows that the handle is protected from accidental disengagement during use, and provides that it will likely be knocked into engagement during use if accidentally left in the release position.

Figure 6:
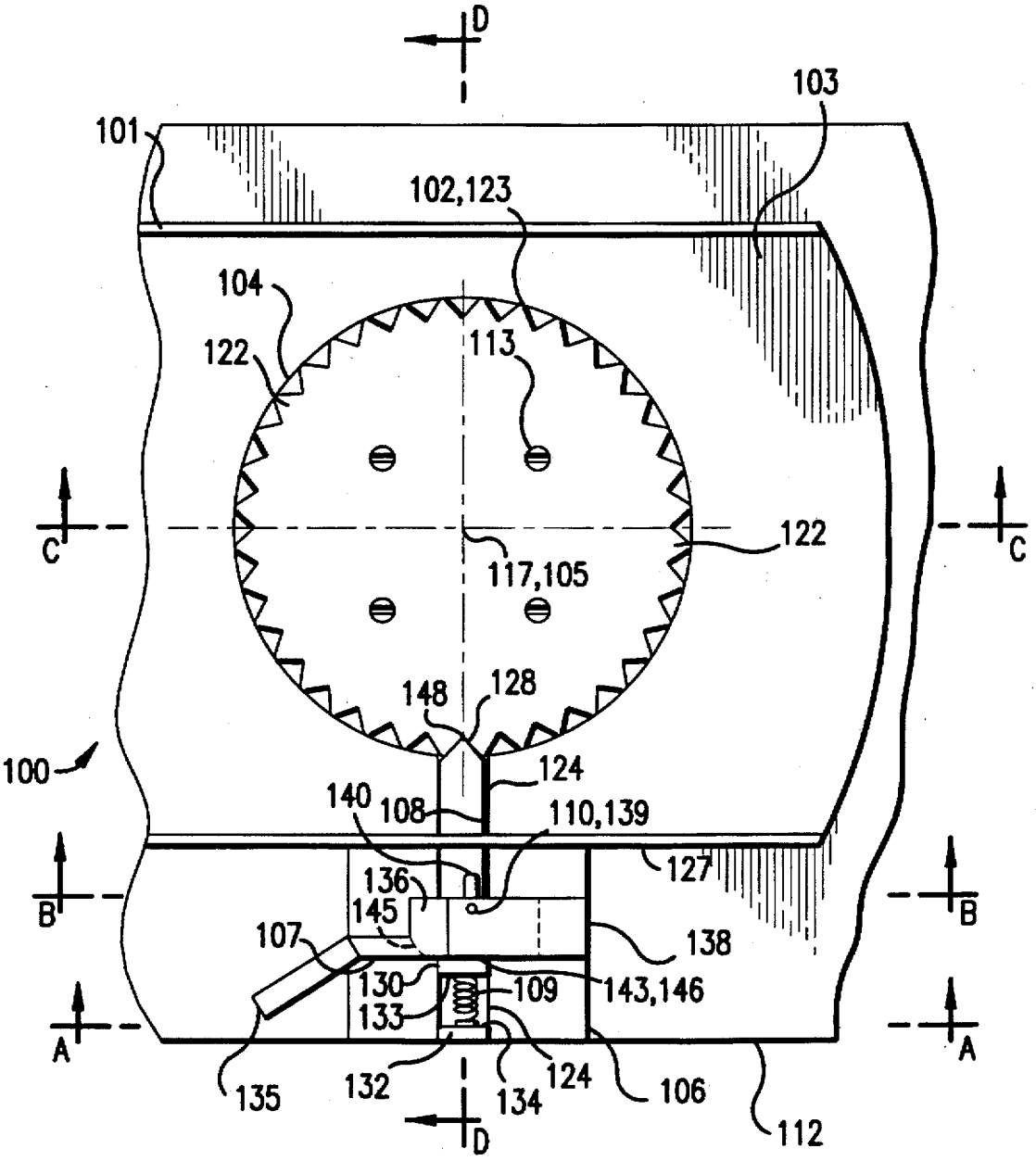
FIG. 6 is a top view of the preferred embodiment in the engagement mode and longitudinally aligned with the snowboard.
Figure 7:
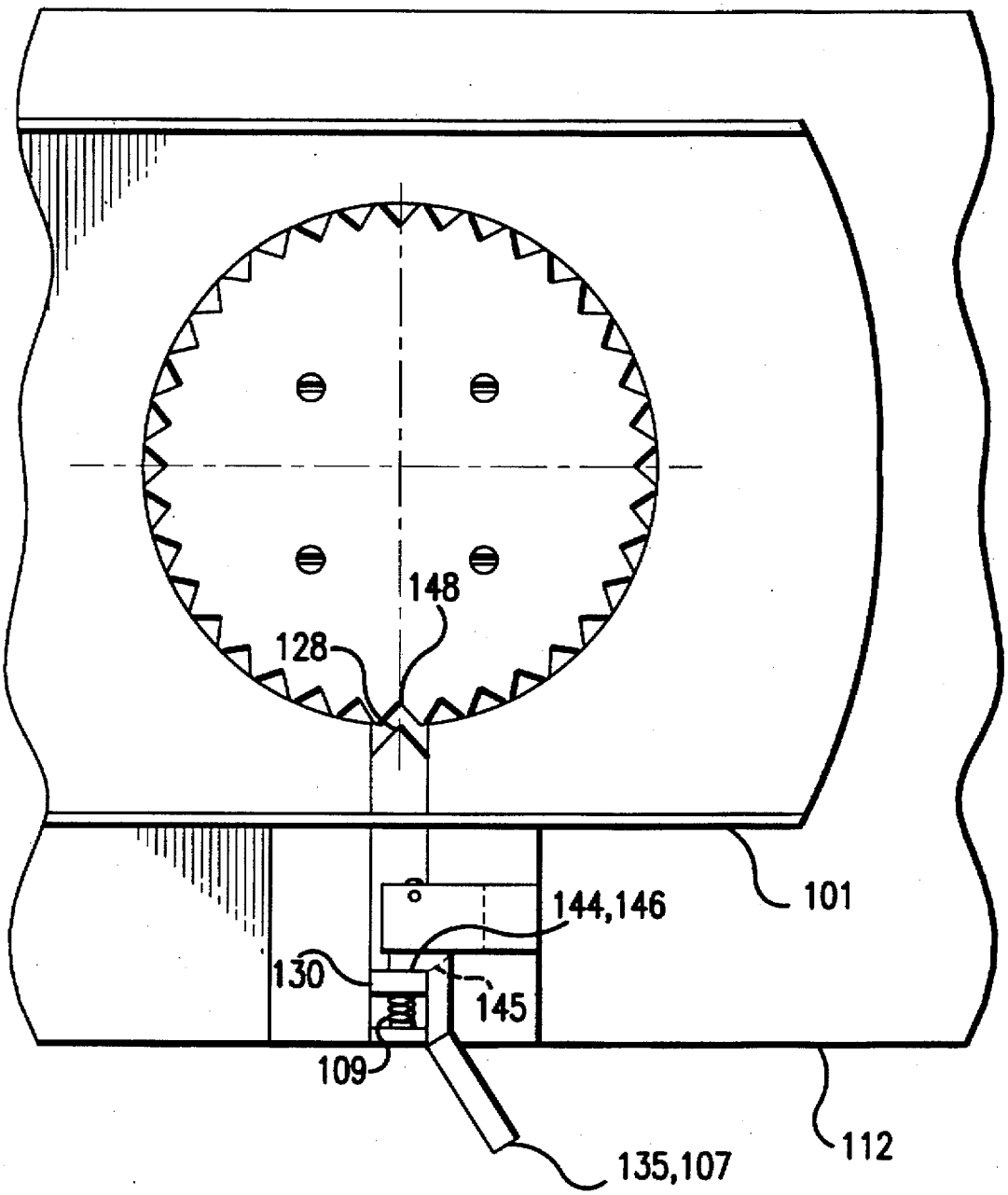
FIG. 7 is a top view of the preferred embodiment in the release mode and longitudinally aligned with the snowboard.
Figure 8:
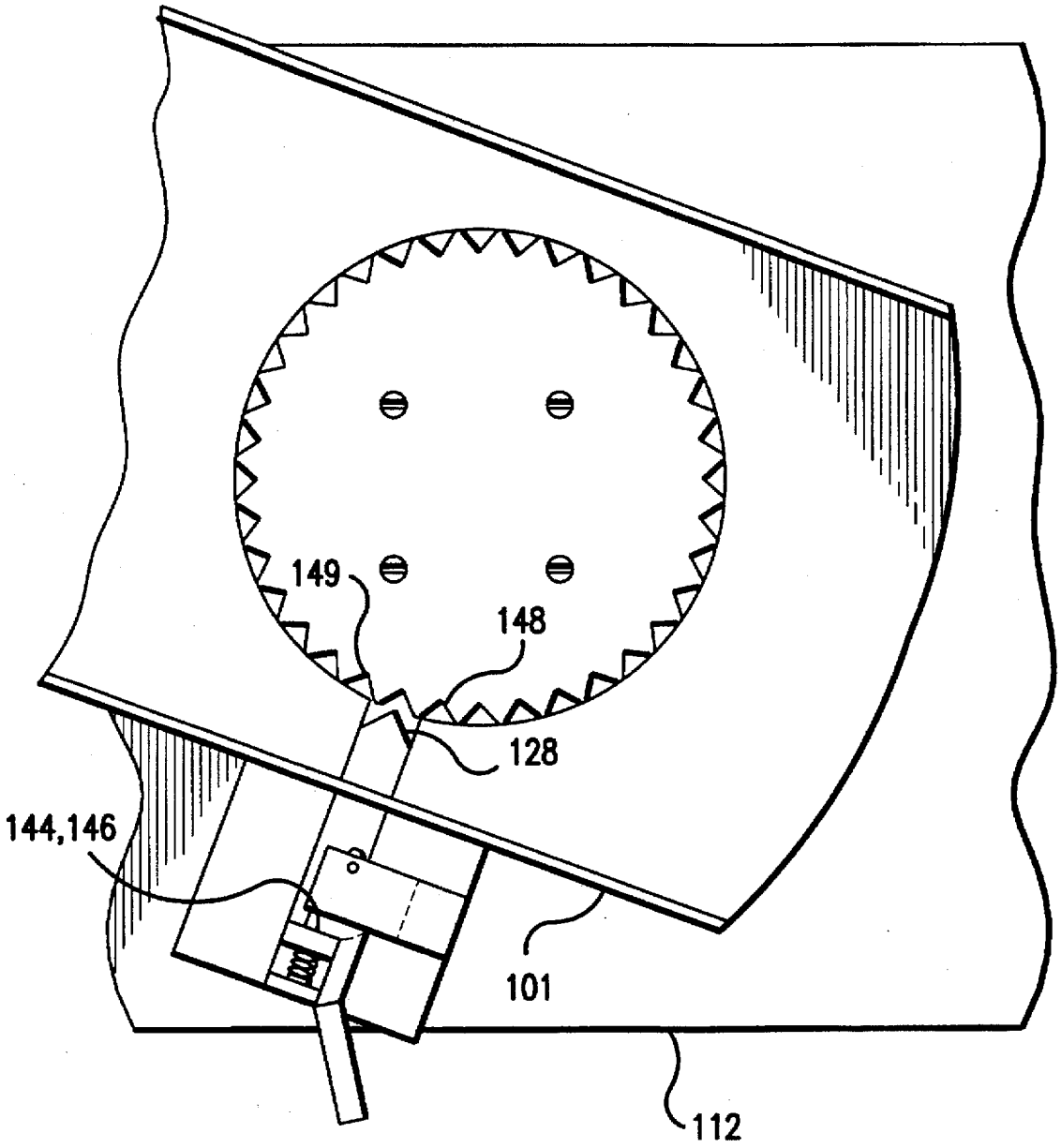
FIG. 8 is a top view of the preferred embodiment in the release mode and pivoted clockwise from the alignment of FIG. 7.
Figure 9:
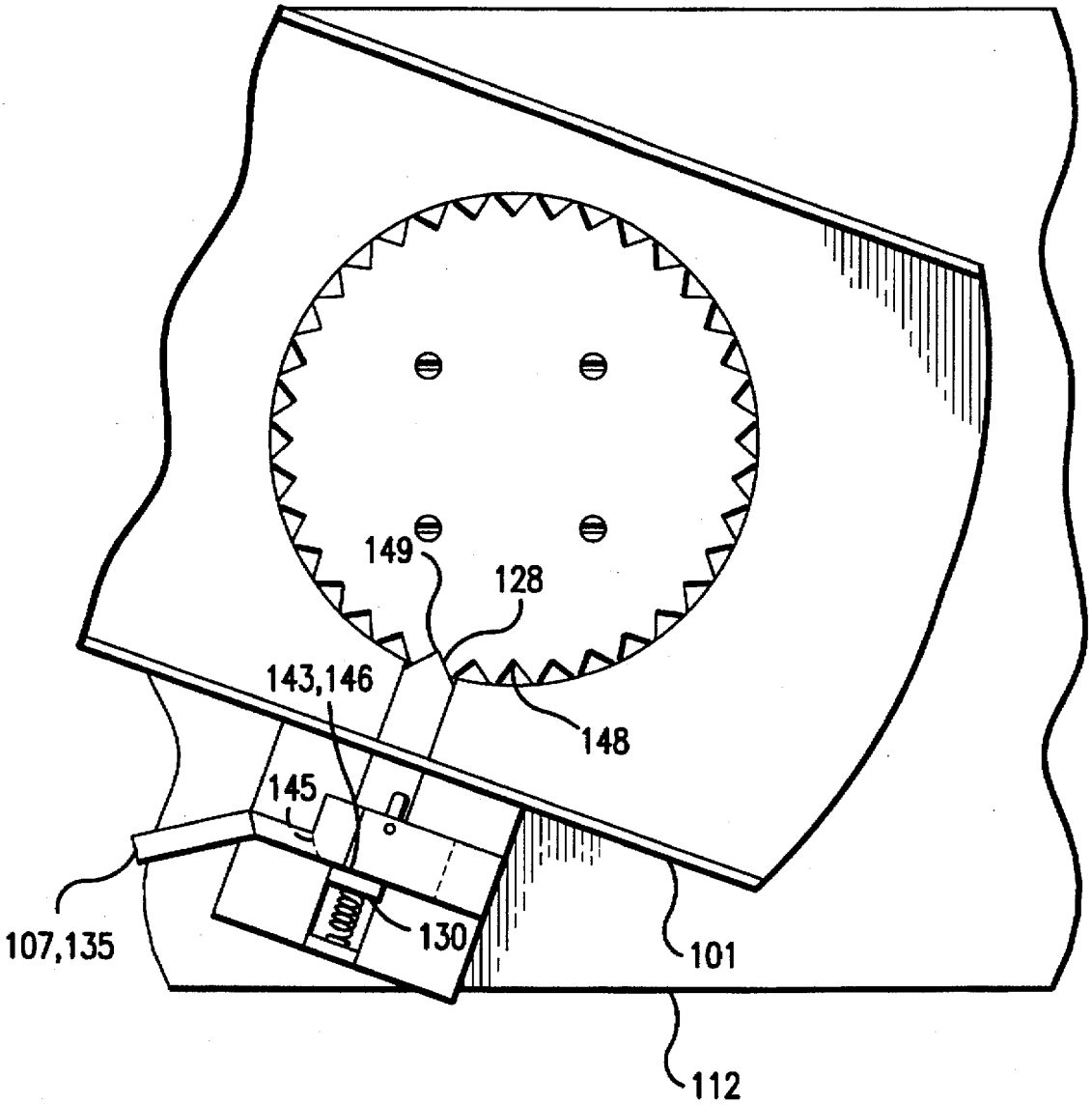
FIG. 9 is a top view of the preferred embodiment in the engagement mode and the pivoted position of FIG. 8.
Figure 10:
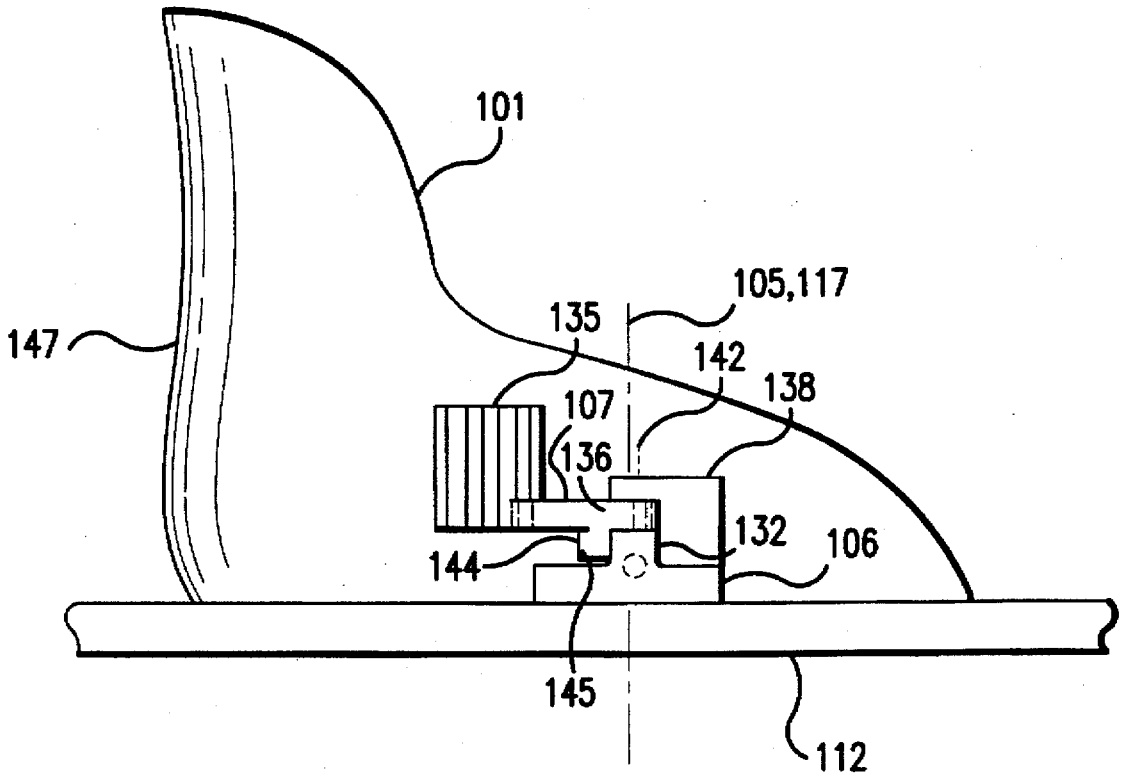
FIG. 10 is a side view of the preferred embodiment in the engagement mode.
Figure 11:
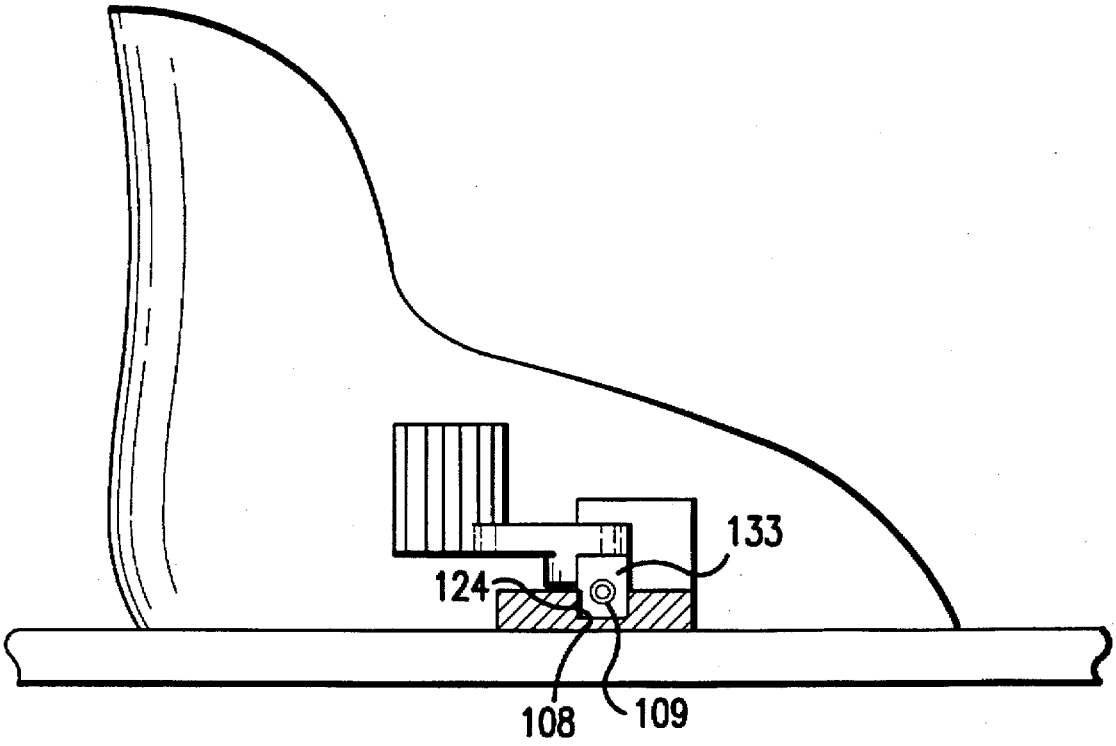
FIG. 11 is a cut-away side-view of the preferred embodiment taken at plane A—A of FIG. 6.
Figure 12:
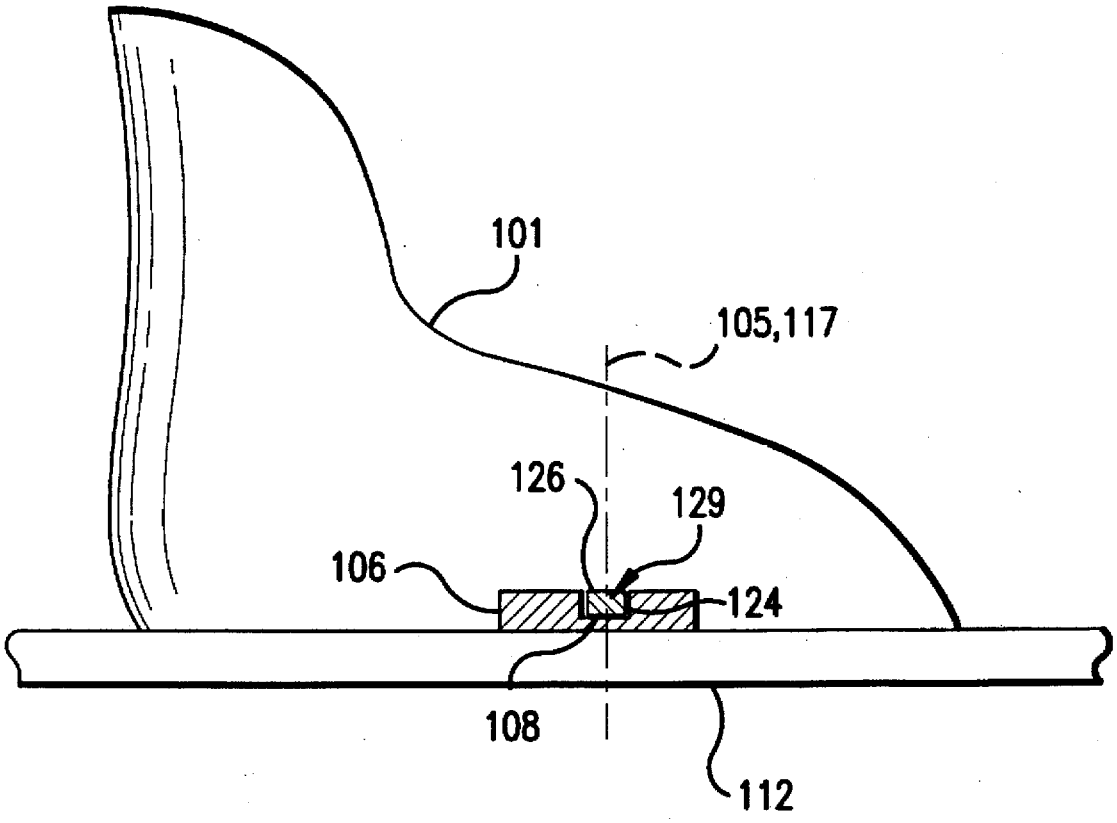
FIG. 12 is a cut-away side-view of the preferred embodiment taken at plane B—B of FIG. 6.

The mechanics of a typical adjustment procedure, changing the binding's rotational position from aligned forwardly with the snowboard to a position rotated slightly clockwise therefrom, is depicted in sequence in FIGS. 6 through 9. In FIG. 6, the binding 101 is forwardly positioned on the snowboard 112, the latch 107 is in the engagement position, and the detent 108 is engaging a first position locating void 148 of the hold-down plate 102. In FIG. 7, the latch has been moved to the release position, disengaging the detent from the hold-down plate. In FIG. 8, with the latch still in the release position, the binding 101 has been rotated approximately two increments clockwise. In FIG. 9, the latch has been returned to the engagement position and the detent again engages the hold-down plate, now at a second position locating void 149.

Figure 15:
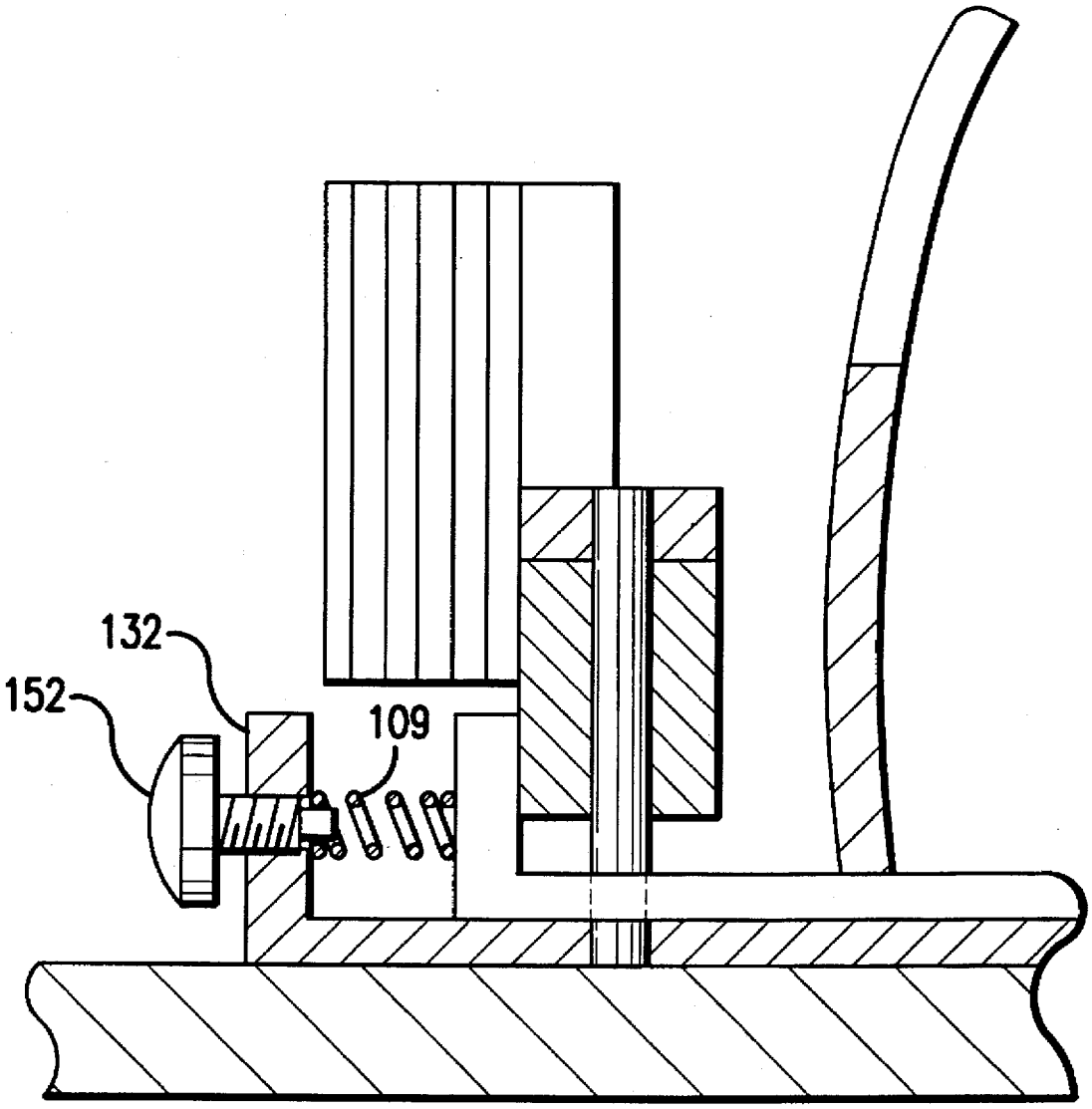
FIG. 15 is a partial cut-away front view of the detent mechanism of a second binding system in accordance with the invention.

The detent's pointed tip 128, the hold-down plate's vee-shaped position locating voids 122, and the spring 109 further cooperate to serve a clutch function by providing that a strong rotational force to the binding 101 about the pivot axis 105 will cause the detent to retract against the force of the spring by the camming forces of the pointed tip against the void it engages. The particular rotational force at which the spring force will be overcome, being the clutch threshold force, may be controlled by alteration of the spring extension force. In FIG. 15, an embodiment of the invention is depicted in which the spring' force is adjustable by means of adjustable screwknob 152 which threadedly engages the base extension's vertical wall 132 and thereby compresses or relaxes the spring 109 as it is helically rotated by the user.

Those skilled in the art will recognize that there are many variations of the invention that are within the scope of the invention, therefore, the invention herein claimed is to be defined only by the limitations and the equivalents thereof which the following sets forth.

I claim:

1. A snowboard binding system for releasably attaching a snowboard to a user's foot and comprising:

a hold-down plate adapted to engage a snowboard said hold-down plate defining a pivot axis;

a binding including a base portion adapted for pivotal engagement to said snowboard by said hold-down plate about said pivot axis;

an angular position index comprised within said hold-down plate and radially disposed about said pivot axis;

an angular position lock comprised within said base portion and pivotably fixed thereto about sand pivot axis said angular position lock being disposed and adapted for engaging said angular position index end having a first state and a second state;

a movable lever engaging said angular position lock and said base portion and adapted for transferring said angular position lock between said first and second states;

a clutch to allow pivoting of said base portion relative to said hold-down plate during said first state when a rotational force between said base portion and said hold-down plate about said pivot axis exceeds a predetermined threshold;

wherein during said first state said angular position lock engages said angular position index and thereby denies free pivoting of said base portion relative to said hold-down plate; and during said second state said angular position lock does not engage said angular position index and thereby allows pivoting of said base portion relative to said hold-down plate about said pivot axis;

and wherein said angular position index comprises a plurality of radially disposed features, said plurality of radially disposed features and said angular position lock are adapted for alignment at a plurality of predetermined angular positions of said base portion relative to said hold-down plate about said pivot axis, and said angular position lock is adapted for engaging one or more of said plurality of radially disposed features at said predetermined angular positions, and said first state exists only at said predetermined angular positions.

2. The system of claim 1 wherein said plurality of radially disposed features are comprised within said hold-down plate, said angular position lock is comprised within said base portion and said movable lever engages said base portion.

3. The system of claim 1 wherein said plurality of radially disposed features comprise a plurality of voids radially positioned about said pivot axis, and said lock comprises a detent adapted for engaging one or more of said voids when said base portion is at any one of said predetermined angular positions.

4. The system of claim 3 wherein said detent is biased to engage one or more of said voids.

5. The system of claim 4 wherein said detent is biased to engage one or more of said voids by a spring disposed between said detent and the other of said base portion or said hold down plate, said spring providing a biasing force to said detent to bias said detent to engage one or more of said voids.

6. The system of claim 5 wherein said biased detent further has a third state, said third state being an unstable state wherein said base portion is not at one of said predetermined angular positions and said detent is thereby not aligned with one or more of said voids, and whereby said detent is adapted to engage one or more of said voids as said base portion is rotated relative to said hold-down plate about said pivot axis to one of said predetermined angular positions and said detent thereby becomes aligned with said one or more of said voids, thereby providing said first state.

7. The system of claim 6 wherein said detent and biasing spring further comprise a clutch to allow pivoting of said base portion relative to said hold-down plate during said first state when a rotational force between said base portion and said hold-down plate about said pivot axis exceeds a predetermined threshold.

8. The system of claim 7 further including bias adjustment means to allow variation of said biasing force, and thereby variation of said predetermined rotational force threshold.

9. The system of claim 1 wherein said movable lever is adapted for disposal in two-positions, a first position causing disposal of said angular position lock said first state, and a second position causing disposal of said angular position lock into said second state, and said movable lever includes locking means adapted to lock said movable lever into said second position to thereby lock said angular position lock into said second state.

10. The system of claim 1 wherein said movable lever is adapted for disposal in two stable positions, a first position causing disposal of said angular position lock into said first state, and a second position causing disposal of said angular position lock into said second state.

11. The system of claim 10 wherein said movable lever is an over-center device alternately biased towards the nearest of said first position or said second position.

12. The system of claim 1 wherein said plurality of radially disposed features comprise a gearwheel having alternating spurs and voids equally spaced about said pivot axis, and said lock comprises a detent having a pointed tip, and said predetermined angular positions of said first state comprise angular positions of said base portion relative to said hold-down plate about said pivot axis wherein said detent is aligned with any one of said voids, and said detent is adapted for engaging said gearwheel during said predetermined angular positions by disposal of said pointed tip within said aligned void and between said spurs adjacent thereto.

13. The system of claim 12 wherein said detent is biased to engage said gearwheel by a spring disposed between said detent and the other of said base portion or said hold down plate, said spring providing a biasing force to said detent to bias said detent to engage said gearwheel, said movable lever is adapted for disposal in two positions, a first position allowing disposal of said detent into said first state, and a second position causing disposal of said detent into said second state, and said movable lever includes locking means adapted to lock said movable lever into said second position to thereby lock said detent into said second state.

14. The system of claim 13 wherein said biased detent further has a third state, said third state being an unstable state wherein said base portion is not at one of said predetermined angular positions and said detent is thereby not aligned with one or more of said voids, and said movable lever is disposed in said first position allowing disposal of said detent into said first state, and whereby said detent is adapted to engage one of said voids as said base portion is rotated relative to said hold-down plate about said pivot axis to one of said predetermined angular positions when said detent thereby becomes aligned with said one of said voids, thereby providing said first state.

15. The system of claim 14 wherein said pointed tip further comprises a cam engaging said adjacent spurs, and wherein a rotational force between said base portion and said hold-down plate about said pivot axis exceeding a predetermined threshold causes camming action of said cam against said bias of said spring to comprise a clutch and thereby allow pivoting of said base portion relative to said hold-down plate.

16. A snowboard binding system for releasably attaching a snowboard to a user's foot and comprising:

a hold-down plate adapted to engage a snowboard and comprising a circular gearwheel having a first plurality of spurs and a second plurality of positioning voids equally spaced about a pivot axis;

a binding including a base portion adapted for pivotal engagement to said snowboard by said hold-down plate about said pivot axis, said binding having a third plurality, equal to said second plurality, of predetermined angular positions relative to said snowboard about said pivot axis, said binding comprising;

a detent, disposed radially from said pivot axis and movable radially relative thereto, said detent being biased toward said pivot axis and said gearwheel by a spring disposed between said detent and said base portion, and said detent having a pointed tip adapted for alignment with each positioning void during each corresponding predetermined angular position, and further adapted for and biased towards engagement with said gearwheel by engagement with said each positioning void by disposal of said pointed tip therewithin and between said spurs adjacent thereto, a lever engaging said detent and said base portion and movable by said user while said snowboard is attached to said user's foot between a first position and a second position, and adapted in said first position for allowing said detent to engage said gearwheel, and adapted in said second position for causing disengagement of said gearwheel by said detent, wherein said binding position is substantially locked in one of said predetermined angular positions relative to said snowboard during engagement of said gearwheel by said detent, and is freely pivotal about said pivot axis relative to said snowboard during disengagement thereof.

* * * * *